US007604219B2

(12) United States Patent
Liljedahl

(10) Patent No.: US 7,604,219 B2
(45) Date of Patent: Oct. 20, 2009

(54) PATIENT LIFT SYSTEMS WITH TELESCOPIC LIFTING APPARATUS

(75) Inventor: Gunnar Liljedahl, Lulea (SE)

(73) Assignee: LIKO Research & Development AB, Lulea (SE)

( * ) Notice: Subject to any disclaimer, the term of this patent is extended or adjusted under 35 U.S.C. 154(b) by 0 days.

(21) Appl. No.: 12/007,428

(22) Filed: Jan. 10, 2008

(65) Prior Publication Data

US 2008/0173853 A1 Jul. 24, 2008

(30) Foreign Application Priority Data

Jan. 19, 2007 (SE) ..... 0700121

(51) Int. Cl.
*B66F 19/00* (2006.01)

(52) U.S. Cl. ..... 254/93 R; 254/89 H; 254/102

(58) Field of Classification Search ..... 254/93 R, 254/89 H, 93 H, 102
See application file for complete search history.

(56) References Cited

U.S. PATENT DOCUMENTS

| | | | | |
|---|---|---|---|---|
| 1,705,625 | A | 3/1929 | Mitchell | |
| 1,815,885 | A * | 7/1931 | Bate | 254/102 |
| 1,893,728 | A * | 1/1933 | Bullis | 254/102 |
| 2,917,953 | A * | 12/1959 | Badali | 254/93 HP |
| 3,376,795 | A * | 4/1968 | Allen | 92/130 R |
| 3,730,481 | A * | 5/1973 | Ekonen et al. | 254/93 R |
| 3,738,605 | A * | 6/1973 | Smith | 254/93 R |
| 4,472,183 | A * | 9/1984 | Mace | 55/378 |
| 7,165,908 | B2 | 1/2007 | Liljedahl | |
| 2008/0173853 | A1 * | 7/2008 | Liljedahl | 254/89 R |

FOREIGN PATENT DOCUMENTS

| | | |
|---|---|---|
| CH | 516855 | 3/2002 |
| DE | 29501855 | 1/1996 |
| NL | 1001767 C | 5/1997 |

* cited by examiner

*Primary Examiner*—Lee D Wilson
(74) *Attorney, Agent, or Firm*—Dinsmore & Shohl LLP

(57) ABSTRACT

Patient lift systems having a telescoping lifting apparatus include a telescopically displaceable lifting beam and a fixed lifting beam. The telescopically displaceable lifting beam may be operable to extend out from the fixed lifting beam to a protruded position. A casing may be brought to surround both the telescopically displaceable lifting beam and the fixed lifting beam and extend a certain distance over both the telescopically displaceable lifting beam and the fixed lifting beam when the telescopically displaceable lifting beam is in the protruded position. A pressure spring may be situated within the casing between a top end of the casing, which may surround the telescopically displaceable lifting beam, and a spring support, which may attach to the fixed lifting beam.

17 Claims, 1 Drawing Sheet

1
6
4
A
8
2
3

1
7
5
4
C

2
B
3
7
4
5
1
C
1:2

4
6
B
1:2
8
2

5
6
4
A
1:2
2

PATIENT LIFT SYSTEMS WITH TELESCOPIC LIFTING APPARATUS

TECHNICAL FIELD

This invention relates to an arrangement of at least two telescopically protrudable lifting beams, of which one is connected to a driver in order to displace the second beam in said first beam, whereby a casing can be brought to surround both beams resting on them and extending a long part of the beams.

The lifting beams are normally loaded in their longitudinal direction and they are designed to meet such a load. The lifting beams can be driven hydraulically via gears or manually using rope-driving means or with the help of a crank means.

BACKGROUND

Lifting beams of this type are used to lift a person from a sitting position to a standing position or from one place to another using a lifting support mechanically coupled to a telescopic lifting beam. Telescopic lifting beams of this kind are also used for other lifting purposes for patients.

It has now been shown, e.g. within the medical service, that the lifting beams unintentionally have been loaded by bending, when the telescopic beams are in their protruded position in relation to each other, which have lead to the outer lifting beam becoming bent in the area where it protrudes out of the outer end of the first lifting beam, e.g. the juncture. An object of the invention is to increase the strength of the lifting beams when they are in their protruded position and that this is accomplished by simple means, which are cheap. SE 516855 discloses a casing, which can be displaced on the beams so it covers e.g. half of the fixed beam and the first half of the protrudable beam so that the casing also takes up the bending stresses.

However, a solution to simplify the design of the means, which perform the displacement of the casing when the movable beam is protruded for carrying out its lifting movement, is needed.

BRIEF DESCRIPTION OF THE DRAWINGS

Embodiments of the invention will now be described by reference to the drawings.

DETAILED DESCRIPTION

Figures 1, 2, 3, 4, 5:
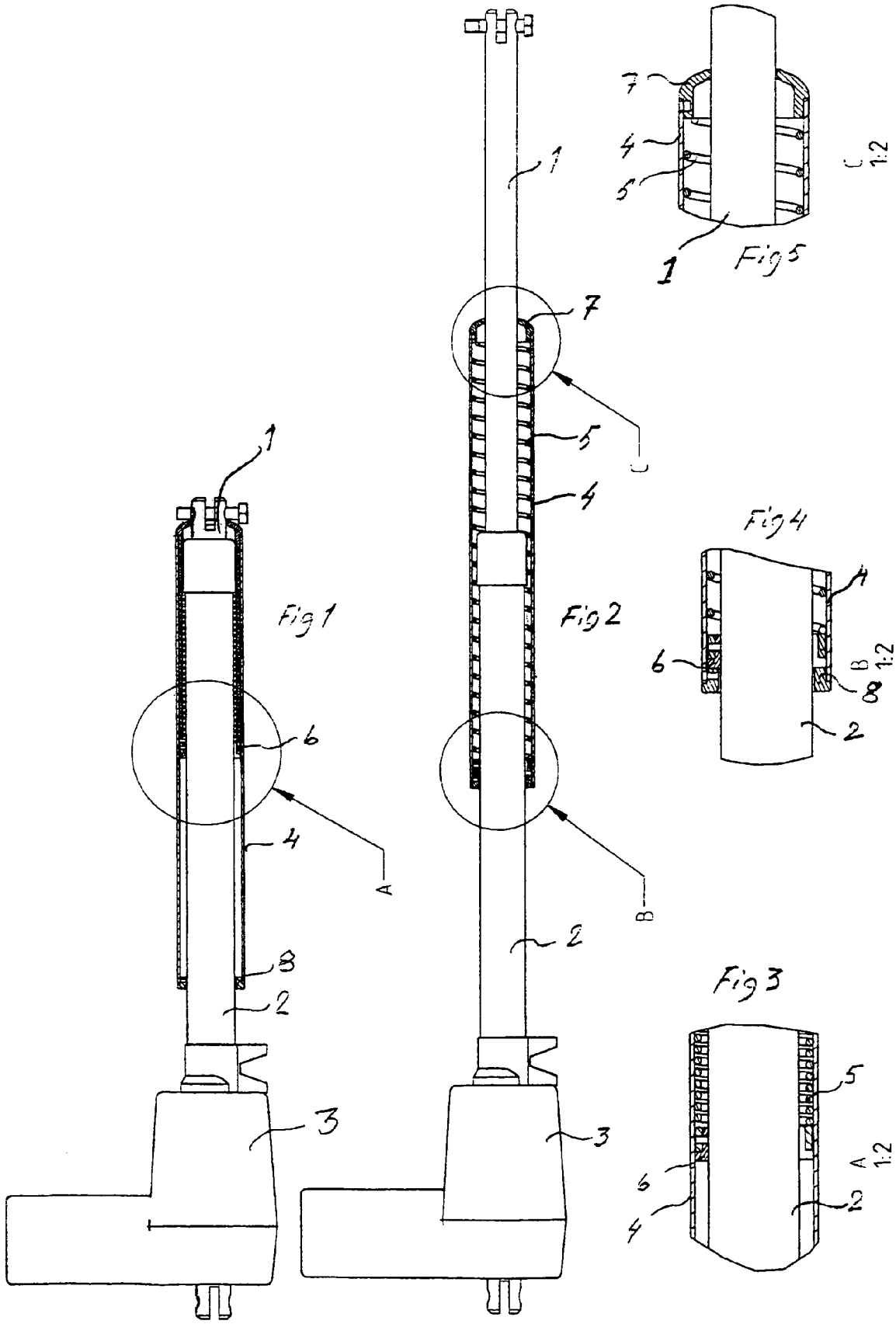
FIG. 1 is a partly longitudinal cross section of the lifting arrangement, having both lifting arms in retracted position.
FIG. 2 is a partly longitudinal cross section as in FIG. 1, but the movable lifting arms are in protruded position.
FIG. 3 is an enlarged cross section at the position a in FIG. 1.
FIG. 4 is an enlarged part of the cross section at position B in FIG. 2.
FIG. 5 is a part of an enlarged cross section at position C in FIG. 2.

A telescoping lifting apparatus may be used in conjunction with a patient lift, such as used in the medical field. Generally, a telescoping lifting apparatus, an exemplary embodiment of which is shown in FIGS. 1 and 2, may comprises a telescopically displaceable lifting beam 1, that telescopes from a fixed lifting beam 2 between a retracted position (FIG. 1) and a protruded position (FIG. 2) via a driver 3. The telescopically displaceable lifting beam 1 and the fixed lifting beam 2 may comprise a substantially elongated cylindrical shape where the telescopically displaceable lifting beam 1 may have a diameter less than that of the fixed lifting beam 2. The telescopically displaceable lifting beam 1 may be axially aligned with the fixed lifting beam 2 such that the fixed lifting beam 2 may house the telescopically displaceable lifting beam 1. The fixed lifting beam 2 may further comprise an opening about one end creating a juncture for the telescopically displaceable lifting beam 1 to enter and exit the fixed lifting beam 2. The driver may comprise a motor, engine, mechanical gear apparatus or any other device known to those skilled in the art suitable to displace the telescopically displaceable lifting beam 1. Furthermore, as can be seen from FIGS. 1 and 2, the telescopically displaceable lifting beams 1 and the fixed lifting beam 2 may be surrounded by a telescopic pipe or casing 4, which is displaceable over the two lifting beams 1 and 2.

The casing 4 may similarly comprise a substantially elongated cylindrical shape with a diameter greater than that of the fixed lifting beam 2. The casing 4 may thereby be configured to rest on the telescoping lifting apparatus external the fixed lifting beam 2 so that it may displace about the surface of the telescoping lifting apparatus when it transitions between the retracted (FIG. 1) and protruded (FIG. 2) positions. When in the retracted position (FIG. 1), a top end of the casing 4 may abut a top portion of the telescopically displaceable lifting beam 1 while a bottom end of the casing 4 may rest about the fixed lifting beam 2. Alternatively, when in the protruded position (FIG. 2), the top end of the casing 4 and the bottom end of the casing 4 may surround the juncture such that the casing 4 thereby surrounds the juncture. Furthermore, where height may be defined as a length in the axial direction, the casing 4 may define a height similar to or less than the height of the fixed lifting beam 2 such that when the telescoping lifting apparatus is in the retracted position, the casing 4 does not extend past the juncture.

As seen in FIGS. 2 and 5, the top end of the casing 4 may further comprise a cover 7. The cover 7 may substantially enclose the top end of the casing 4 about the telescopically displaceable lifting beam 1.

The casing 4 may house a pressure spring 5 to assist in displacing the casing 4 during operation of the telescoping lifting apparatus. A top end of the pressure spring 5 may be supported by, or abut with, the top end of the casing 4. Where the top end of the casing 4 comprises a cover 7, the top end of the pressure spring 5 may be supported by, or abut with, the cover 7. A bottom end of the pressure spring 5 may be supported by, or abut with, a spring support attached to the fixed lifting beam 2. The spring support 6 may be positioned between a top end of the fixed lifting beam 2 and a bottom end of the fixed lifting beam 2. As exemplified in FIG. 1, in one embodiment, the spring support 6 may be positioned substantially halfway between the top end of the fixed lifting beam 2 and the bottom end of the fixed lifting beam 2. Furthermore, as seen in FIGS. 1 and 4, the bottom end of the casing 4 may comprise a ring 8. The ring 8 may be configured to engage the spring support 6 to inhibit the bottom end of the casing 4 from passing the spring support 6.

When the telescoping lifting apparatus is in a retracted position, as seen in FIG. 1, the top end of the casing 4 will be relatively proximal to the spring support 6 thereby compressing the pressure spring 5. The pressure spring 5 may thereby continue to exert an outward force on both the top end of the casing 4 and the spring support 6. Conversely, when the telescoping lifting apparatus is in the protruded position, as seen in FIG. 2, the top end of the casing 4, which supports the top end of the pressure spring 5, is relatively distal the spring support 6. The pressure spring 5 is thereby allowed to expand and the casing 4 is forced in a direction similar to the telescopically displaceable arm 1.

However, as best seen in FIG. 4, when the bottom end of the telescopically displaceable arm 1 engages the spring support 6 and/or the ring 8, the upward movement of the casing 4 is resisted such that the casing 4 substantially surrounds a portion of both the telescopically displaceable lifting beam 1 and the fixed lifting beam 2 about the juncture. As seen in FIG. 2, where the spring support 6 is disposed halfway between the top end of the fixed lifting beam 2 and the bottom end of the fixed lifting beam 2, and both the telescopically displaceable lifting beam 1 and the casing 4 define heights similar to that of the fixed lifting beam 2, the casing 4 may be substantially centered about the juncture and surround proportional amounts of both the telescopically displaceable lifting beam 1 and the fixed lifting beam 2.

However, the power and length of the pressure spring 5, and the length of the casing 4, can be so adapted that the casing 4 will cover the desirable amount of both the telescopically displaceable lifting beam 1 and the fixed lifting beam 2 when the telescopically displaceable lifting beam 1 is in its most protruded position. When the telescoping lifting apparatus is in the protruded position, the casing 4 will take up bending forces on the lifting beams at the juncture where a load is applied the telescopically displaceable lifting beam 1.

While the casing 4 displaces based on the expansion and compression of the pressure spring 5, the expansion and compression of the pressure spring 5 is controlled by the movement of the telescopically displaceable lifting beam 1. And, the movement of the telescopically displaceable lifting beam 1 is controlled by the driver 3. So, when the driver 3 manipulates the telescopically displaceable lifting beam 1, the casing 4 may autonomously adjust its position to surround the juncture and aid in the support of external loads.

The telescoping lifting apparatus may further be implemented into a patient lift system. For example, a lifting support may be configured to aid in the lifting of a patient and may be mechanically coupled to the telescopically displaceable lifting beam. When the telescoping lifting apparatus transitions to the protruded position, the lifting support transitions to a lifted position via the telescopically displaceable lifting beam. The patient lift system may thereby be implemented to lift a person from a sitting position to a standing position or from one place to another. In the alternative, the patient lift system may be used for other lifting purposes as known to those skilled in the art.

There are alternative solutions within the scope of the invention as for instance the design of the supports, the design of the cover 7 and also the design of the support ring 8. The support ring 8 may be omitted by that the outer dimension of the fixed lifting beam 2 is adapted to the inner dimension of the casing 4 in an area below the pressure spring 5, that is to say in the area B according to FIG. 2. The upper end of the casing 4 can be designed in another way and have a design similar to a ring instead of a cover. Finally, it should be noted that in the foregoing disclosure two lifting beams have been described but the inventive idea also includes several lifting beams arranged one after the other.

The invention claimed is:

1. A telescoping lifting apparatus comprising a telescopically displaceable lifting beam and a fixed lifting beam, the telescopically displaceable lifting beam being operable to extend out from the fixed lifting beam to a protruded position, wherein a casing surrounds both the telescopically displaceable lifting beam and the fixed lifting beam and extends a certain distance over both the telescopically displaceable lifting beam and the fixed lifting beam when the telescopically displaceable lifting beam is in the protruded position, and wherein a pressure spring is situated within the casing between a top end of the casing which surrounds the telescopically displaceable lifting beam and a spring support which is attached to the fixed lifting beam between a top end and a bottom end and extends outwardly therefrom.

2. The telescoping lifting apparatus of claim 1, wherein a bottom end of the casing comprises a ring.

3. The telescoping lifting apparatus of claim 1, wherein the top end of the casing comprises a cover.

4. The telescoping lifting apparatus of claim 1 wherein the telescopically displaceable lifting beam is coupled to a driver.

5. The telescoping lifting apparatus of claim 4 wherein the driver is configured to extend and retract the telescopically displaceable lifting beam between the protruded position a retracted position.

6. A telescoping lifting apparatus having a retracted position and a protruded position, the telescoping lifting apparatus comprising:

a fixed lifting beam and a telescopically displaceable lifting beam at least partially received within the fixed lifting beam, the telescopically displaceable lifting beam exiting the fixed lifting beam at a juncture;

a casing surrounding the fixed lifting beam and the telescopically displaceable lifting beam, the casing housing a pressure spring supported by a spring support attached to the fixed lifting beam between a top end and a bottom end and extending outwardly therefrom;

wherein, as the telescoping lifting apparatus transitions between the retracted position and the protruded position, the pressurized spring displaces the casing to surround portions of the fixed lifting beam and the telescopically displaceable lifting beam both above and below the juncture.

7. The telescoping lifting apparatus of claim 6 wherein a first end of the pressure spring is supported by a top end of the casing.

8. The telescoping lifting apparatus of claim 7 wherein a bottom end of the casing comprises a ring.

9. The telescoping lifting apparatus of claim 7 wherein the top end of the casing comprises a cover.

10. The telescoping lifting apparatus of claim 6 wherein the telescopically displaceable lifting beam is coupled to a driver.

11. The telescoping lifting apparatus of claim 10 wherein the driver is configured to extend and retract the telescopically displaceable lifting beam when the telescoping lifting apparatus transitions between the retraced position and the protruded position.

12. A patient lift system having a telescoping lifting apparatus having a retracted position and a protruded position, the patient lift system comprising:

a fixed lifting beam and a telescopically displaceable lifting beam at least partially received within the fixed lifting beam, the telescopically displaceable lifting beam exiting the fixed lifting beam at a juncture;

a casing surrounding the fixed lifting beam and the telescopically displaceable lifting beam, the casing housing a pressure spring supported by a spring support attached to the fixed lifting beam between a top end and a bottom end and extending outwardly therefrom, wherein, as the telescoping lifting apparatus transitions between the retracted position and the protruded position, the pressurized spring displaces the casing to surround portions of the fixed lifting beam and the telescopically displaceable lifting beam both above and below the juncture; and, a lifting support configured to aid in the lifting of a patient, the lifting support mechanically coupled to the telescopically displaceable lifting beam such that when the telescoping lifting apparatus is in the protruded position, the lifting support is in a lifted position.

13. The patient lift system of claim 12 wherein a first end of the pressure spring is supported by a top end of the casing.

14. The patient lift system of claim 12 wherein a bottom end of the casing comprises a ring.

15. The patient lift system of claim 12 wherein the top end of the casing comprises a cover.

16. The patient lift system of claim 12 wherein the telescopically displaceable lifting beam is coupled to a driver.

17. The patient lift system of claim 16 wherein the driver is configured to extend and retract the telescopically displaceable lifting beam when the telescoping lifting apparatus transitions between the retraced position and the protruded position.

* * * * *